US008480456B1

(12) United States Patent
Ko

(10) Patent No.: US 8,480,456 B1
(45) Date of Patent: Jul. 9, 2013

(54) ULTRA-FLAT, HIGH THROUGHPUT WAFER LAPPING PROCESS

(71) Applicant: Donggeun Ko, Long Grove, IL (US)

(72) Inventor: Donggeun Ko, Long Grove, IL (US)

(73) Assignee: Rubicon Technology, Inc., Bensenville, IL (US)

( * ) Notice: Subject to any disclaimer, the term of this patent is extended or adjusted under 35 U.S.C. 154(b) by 0 days.

(21) Appl. No.: 13/687,261

(22) Filed: Nov. 28, 2012

Related U.S. Application Data

(62) Division of application No. 11/769,700, filed on Jun. 27, 2007, now Pat. No. 8,348,720.

(60) Provisional application No. 60/944,871, filed on Jun. 19, 2007.

(51) Int. Cl.
*B24B 7/22* (2006.01)

(52) U.S. Cl.
USPC ..... 451/270; 451/271; 451/285

(58) Field of Classification Search
USPC ..... 451/41, 56, 270, 271, 285–290
See application file for complete search history.

(56) References Cited

U.S. PATENT DOCUMENTS 2,284,056 A * 5/1942 Indge ..... 451/159
4,000,019 A 12/1976 Van Den Brekel
4,165,584 A * 8/1979 Scherrer ..... 451/289
4,861,418 A 8/1989 Nishimura
5,060,043 A 10/1991 Yasue
5,174,067 A 12/1992 Hasegawa
5,333,413 A 8/1994 Hashimoto
5,361,545 A 11/1994 Nakamura
5,647,789 A 7/1997 Kitta
5,697,832 A 12/1997 Greenlaw
5,733,175 A 3/1998 Leach
5,751,055 A 5/1998 Maruyama et al.
5,762,537 A 6/1998 Sandhu
5,951,380 A 9/1999 Kim
6,004,193 A 12/1999 Nagahara
6,054,017 A 4/2000 Yang
6,074,277 A 6/2000 Arai
6,080,048 A 6/2000 Kotagiri
6,086,457 A 7/2000 Perlov
6,120,347 A 9/2000 Sandhu
6,120,352 A 9/2000 Duescher
6,149,506 A 11/2000 Duescher
6,152,806 A 11/2000 Nystrom
6,168,684 B1 1/2001 Mitsuhashi
6,338,667 B2 1/2002 Sandhu
6,346,036 B1 2/2002 Halley
6,375,550 B1 4/2002 Berman (Continued)

*Primary Examiner* — Maurina Rachuba
(74) *Attorney, Agent, or Firm* — McGuireWoods LLP

(57) ABSTRACT

The present invention comprises of a process for lapping a high-throughput of ultra-flat wafers by utilizing a lapping apparatus containing a rotary flat, grooved polishing platen, at least two rotating pressurized heads each having a polishing wafer carrier that is adapted to receive a plurality of mounted wafers, and a plurality of concentric conditioning rings surrounding each pressurized head. The rotating pressurized heads are counterbalanced throughout the inventive process, and the lapping platen is continuously conditioned by simultaneously rotating the concentric conditioning rings over the lapping platen. This process allows continuous and controllable planarization thus allowing for a high throughput of wafers, while at the same time it prevents distortions in the lapping platen which reduces maintenance by providing continuous conditioning of the lapping platen. Further this inventive process allows substantially the entire surface of each wafer carrier to be utilized while maintaining a high quality planarized wafer product, highly desired in the semiconductor industry.

10 Claims, 9 Drawing Sheets

U.S. PATENT DOCUMENTS

| | | | | |
|---|---|---|---|---|
| 6,432,823 | B1 | 8/2002 | Huynh | |
| 6,537,135 | B1 | 3/2003 | Easter | |
| 6,539,277 | B1 * | 3/2003 | Alvis | 700/191 |
| 6,575,825 | B2 | 6/2003 | Tolles | |
| 6,612,905 | B2 * | 9/2003 | Nguyen | 451/28 |
| 6,629,874 | B1 | 10/2003 | Halley | |
| 6,632,127 | B1 | 10/2003 | Zimmer | |
| 6,672,943 | B2 | 1/2004 | Vogtmann | |
| 6,702,657 | B2 | 3/2004 | Ficarro | |
| 6,769,969 | B1 | 8/2004 | Duescher | |
| 6,793,565 | B1 | 9/2004 | Chadda | |
| 6,855,030 | B2 | 2/2005 | Halley | |
| 7,004,822 | B2 | 2/2006 | Moloney | |
| 7,081,038 | B2 | 7/2006 | Ina | |
| 7,102,206 | B2 | 9/2006 | Hidaka | |
| 7,104,871 | B1 | 9/2006 | Kennedy | |
| 7,166,016 | B1 | 1/2007 | Chen | |
| RE39,484 | E | 2/2007 | Bruel | |
| 7,172,493 | B2 | 2/2007 | Novak | |
| 7,186,165 | B2 | 3/2007 | Jeong | |
| 2001/0029158 | A1 | 10/2001 | Sasaki | |
| 2002/0049029 | A1 | 4/2002 | Large | |
| 2003/0175531 | A1 | 9/2003 | Fournel | |
| 2005/0106840 | A1 | 5/2005 | Arai | |
| 2006/0030157 | A1 | 2/2006 | Ivanov | |
| 2006/0105680 | A1 | 5/2006 | Jeong | |
| 2007/0049179 | A1 | 3/2007 | Chandrasekaran | |

* cited by examiner

PRIOR ART

ULTRA-FLAT, HIGH THROUGHPUT WAFER LAPPING PROCESS

CROSS-REFERENCE TO RELATED APPLICATIONS

This is a divisional of U.S. Non-Provisional patent application Ser. No. 11/769,700, filed Jun. 27, 2007 which claims the benefit and priority of U.S. Provisional Patent Application No. 60/944,871 filed on Jun. 19, 2007, the disclosures of which are incorporated by reference herein in their entirety.

FIELD OF THE INVENTION

The present invention relates to the field of high throughput lapping processes used for the planarization of semiconductor and optoelectronic substrates including sapphire wafers or any other suitable material requiring planarization whereby machines having multiple polishing heads and concentric conditioning rings are provided in balanced pairs such that one head rotates clockwise while the other rotates counterclockwise, in order to reduce distortions and/or maintain high levels of planarization in both the lapping platen and the final product.

BACKGROUND OF THE INVENTION

Currently, in the marketplace, there are available a wide variety of polishing and/or planarization devices and processes for producing semiconductor wafers. In the semiconductor manufacturing industry, it is often necessary for semiconductor wafers to be as close to uniform and planar, as the current methodology will allow. This is achieved by utilizing various devices and processes during the final grinding and polishing phases of the manufacturing process of semiconductor wafers wherein the wafer is polished to remove uneven surfaces, scratches and roughness. However, most of these conventional methods lead to distortions in the platen and thus result in an undesirable lack of uniformity of wafers, such as high thickness variation, taper, et cetera, following the lapping process.

In reviewing the prior art, there are a wide variety of wafer lapping devices and processes disclosed. Conventionally, a wafer lapping process in the semiconductor industry will utilize a device which will provide an upper pressurizing head or lapping plate, a lower lapping plate, a set of planetary gears, a plurality of wafer carriers, a wafer loader assembly, and a wafer unloader assembly. Generally these lapping plates polish and planarize the wafers by rotating clockwise or counterclockwise bearing upon the wafers loaded upon the wafer carriers. For example, the Hasegawa et al. U.S. Pat. No. 5,174,067 discloses a typical wafer lapping apparatus that also utilizes a pair of turntable stages where each has a vertical central shaft and a pin where the wafer carriers are piled upon. Further, the Hashimoto U.S. Pat. No. 5,333,413 discloses a typical automatic wafer lapping apparatus wherein the wafer lapping apparatus further includes a position sensor for detecting the position of the wafer carriers and a device for cleaning the wafer holder. Similarly, the Nakamura U.S. Pat. No. 5,361,545 discloses a polishing device wherein four polishing devices are linearly arranged and provide arm shafts capable of moving in the longitudinal direction wherein wafers may be moved between a discharge position upon a polishing plate and a specified position outside the polishing plate.

The Kifta U.S. Pat. No. 5,647,789, also discloses a polishing machine having a plurality of carriers and method which includes a polishing disc that rotates first in one direction, and then in a reverse direction, in order to more effectively spread slurry and optimize planarization. It is also provided with a pair of guide rollers for pinching a holding member. Similarly, the Greenlaw U.S. Pat. No. 5,697,832 discloses a planetary grinding or polishing machine wherein an outer ring gear, upper platen and lower platen are independently rotatable in a clockwise or counterclockwise position.

The Leach U.S. Pat. No. 5,733,175 also discloses a polishing apparatus having rotatable plates wherein the polishing plate and workpiece plate rotate at a constant rate relative to each other. This device has two overlapping platens, one holds a workpiece while the other holds a polishing pad and rotates in the same direction, either clockwise or counterclockwise.

In Sandhu U.S. Pat. No. 5,762,537 a system is disclosed for polishing a semiconductor wafer having means for heating a wafer while it is being polished by a polishing head and means to apply pressure where desired. A processor is provided which can control both the processing rate and pressure upon the workpiece.

Further, the Kim U.S. Pat. No. 5,951,380 discloses a polishing method and apparatus that utilizes different polishing materials on a single pad to control the polishing characteristics, while the Nagahara U.S. Pat. No. 6,004,193 discloses a polishing apparatus that employs a retainer ring which retains a semiconductor wafer against the polishing pad while it also conditions the pad during wafer polishing or any substrate.

In the semiconducting industry, wafers are generally polished by being pressed between two rotatable plates. The Yang U.S. Pat. No. 6,054,017 discloses a polishing apparatus where a wafer is pressed between a polishing head and polishing pad which are both rotatable. Similarly, the Arai U.S. Pat. No. 6,074,277 discloses a polishing apparatus with a rotating plate, but this plate comprises an inner peripheral portion and a donut-shaped outer portion that may rotate independently of one another in opposite directions at controlled speeds to make the wear of the polishing pad and the inner plate substantially equal.

Further, the Kotagiri U.S. Pat. No. 6,080,048 discloses a polishing machine that has a carrier providing through-holes to accommodate wafers which are pinched between two polishing plates and has both sides polished by a driver mechanism that moves the carrier along a circular orbit without revolving.

The Perlov U.S. Pat. No. 6,086,457 discloses an apparatus and method for transferring wafers between polishing heads and washer stations. Robotics are used to transfer the wafers during processing and multiple heads are utilized to improve performance.

The Sandhu U.S. Pat. No. 6,120,347 discloses a system which includes a polishing assembly having a polishing plate, a wafer carrier, and a controller to adjust polishing parameters such as polishing rates, polishing pressure and positioning.

The Deuscher U.S. Pat. No. 6,120,352 discloses a method of lapping or polishing using an adjustable flat surface and abrasive sheets, wherein gaseous pressure is reduced between the back of the abrasive sheet and the platen. Further, in the Duescher U.S. Pat. No. 6,149,506, this reference discloses a method and apparatus for high speed lapping with a rotatable platen having an abrasive surface, a moveable work piece holder, and a flexible shaft which are cable of polishing at extremely high speeds. This reference also discloses the use of a work piece holder as a segment of a spherical element, a cylindrical housing and a gimbal mechanism. A vacuum is used to secure the workpiece. Duescher, U.S. Pat. No. 6,769,969 B1 also discloses raised island abrasive sheet materials containing a thin coating of diamond particles, and a method for using the abrasive sheeting during a high speed lapping process.

The Nystrom U.S. Pat. No. 6,152,806 discloses a chemical mechanical polishing ("CMP") apparatus with concentric platens that can be rotated independently of each other in either a clockwise or counterclockwise direction. A polishing pad is attached to each platen.

The Mitsuhashi U.S. Pat. No. 6,168,684 B1 discloses a wafer polishing method and apparatus which has a rotary polishing bed, an abrasive cloth, a rotary driver for the wafer, and a grooved retaining ring. The polishing slurry is dispensed in a direction opposite that of the polishing pad.

The Sandhu U.S. Pat. No. 6,338,667 B2 discloses a system for real-time control of a semiconductor polishing process having a plate, a wafer carrier and a control which may travel in linear or nonlinear polishing paths. It is also provided with a processor to control rotational velocity of both platen and wafer, the wafer speed across the platen, the pressure exerted on the wafer, slurry composition, flow rate and temperature of a wafer surface.

The Halley U.S. Pat. No. 6,346,036 B1 discloses a polishing system with a movable polishing head and dual magazine regions where substrate complexes are placed. Further, the Berman U.S. Pat. No. 6,375,550 B1 discloses an apparatus which has a wafer carrier assembly that is configured to apply pressure to the wafer at two different sets of predetermined positions. The Huynh U.S. Pat. No. 6,432,823 B1 discloses a system of using at least two platens in an off-concentric position to polish a single wafer simultaneously.

The Easter U.S. Pat. No. 6,537,135 B1 discloses a polishing method and apparatus which moves the holding device in a substantially curvilinear path relative to the polishing surface, which curvilinear path preferably comprises a figure eight. Furthermore, the Tolles U.S. Pat. No. 6,575,825 B2 discloses a polishing pad with passageways therethrough which vent to the atmosphere, as they may comprise a variety of groove configurations.

The Halley U.S. Pat. No. 6,629,874 B1 discloses a method for adjusting polishing parameters by using contemporaneous height measurements of the surface of the wafer by reflecting light thereupon.

The Zimmer U.S. Pat. No. 6,632,127 discloses a polishing pad conditioning head with a substrate and a layer of fine-grain chemical vapor deposited polycrystalline diamond bonded to the substrate for crystalline growth thereupon.

The Vogtmann U.S. Pat. No. 6,672,943 B2 discloses an eccentric or elliptical abrasive wheel which interacts with a spindle adapted to hold a wafer to prevent overgrind of the workpiece. An elliptical or oval shaped matrix is utilized to accomplish this purpose.

The Ficarro U.S. Pat. No. 6,702,657 B2 discloses a polishing machine having multiple carriers which are rotated around a vertical axis with roller pairs. Further, the Chadda U.S. Pat. No. 6,793,565 B1 discloses an apparatus with at least two carousels which rotate to polish a workpiece. It also discloses the use of a polishing web with a face.

The Halley U.S. Pat. No. 6,855,030 B2 discloses a method of performing a planarization process using an apparatus having a docking station where one may remove a module while other modules are still being processed. Each module may be independently controlled by separate carriers.

The Moloney U.S. Pat. No. 7,004,822 discloses a polishing method which is based on differing rotation of a pad dresser, head, and/or polishing head in order to increase center removal profile. It also utilizes orbital and spin action during CMP.

The Ina U.S. Pat. No. 7,081,038 B2 discloses a polishing method of polishing a substrate where the substrate and the pad are rotated first in one direction, then in a second direction opposite to the first direction.

The Hidaka U.S. Pat. No. 7,102,206 B2 discloses a semiconductor having a notched edge portion, and a method for making for making the notch and for reducing edge step formation during CMP.

The Kennedy U.S. Pat. No. 7,104,871 B1 discloses a method for resurfacing a compact disc where the disc and the abrasive material are rotated in opposite directions.

The Chen U.S. Pat. No. 7,166,016 B1 discloses a six headed carousel with substrate heads which align with four polishing stations and two load cups with head portions. Each head is configured to support and transfer a substrate.

The Novak U.S. Pat. No. 7,172,493 B2 discloses a polishing apparatus having actuators which rotate the polishing assembly and apply forceto the workpiece. The actuators also cooperate to adjust the pressure of the polishing pad.

The Jeong U.S. Pat. No. 7,186,165 B2 discloses a semiconductor wafer polishing apparatus which may be configured to continuously polish wafers while other wafers are being transferred to different positions. It discloses four wafer carriers and the device further has a small footprint.

The Large U.S. Pat. Pub. No. 2002/0049029 A1 discloses a CMP machine with a spindle coupled to a wafer carrier which is capable of producing microscopic vibrations during the lapping process via a piezoelectric drive.

The Sasaki U.S. Pat. Pub. No. 2001/0029158 A1 discloses a polishing apparatus with a plurality of polishing portions and a cleaning portion. Furthermore, the Ivanov U.S. Pat. Pub. No. 2006/0030157 A1 discloses a method and apparatus for processing microelectronic topographies which include a substrate holder or microelectronic topography which rotates to expose these to a fluid.

The Jeong U.S. Pat. Pub. No. 2006/0105680 A1 discloses an apparatus and method for loading and unloading semiconductor wafers on multiple wafer carriers for continual processing, thereby reducing idle processing time.

The Chandrasekaran U.S. Pat. Pub. No. 2007/0049179 A1 discloses retaining rings and associated planarizing apparatuses which can be positioned on a carrier head. It also discloses the use of grooves in the base surface.

Thus, nowhere in the prior is seen a polishing method where pairs of polishing heads rotating counterclockwise and pairs of heads rotating clockwise are counterbalanced throughout the polishing process in combination with the use of concentric conditioning rings in order to provide improved continuous and controllable planarization resulting in high throughput of premium quality, consistent, ultra-flat wafers by means of maintaining reduced distortion of the lapping platen during processing.

SUMMARY OF THE INVENTION

The present invention solves various problems of the prior art relating to lapping or polishing technology. In the semiconductor industry, the requirements for wafer surfaces are becoming more stringent and more competitive, such that wafers must be produced as perfectly uniform and planar as technology allows. However, during the planarizing process, the rotary lapping platen may become convex or concave across the diameter and/or trenched across the radius, leading to unevenness in the polished wafers produced according to traditional manufacturing methodology. Also, the planarizing devices and processes currently utilized in the industry do not possess capabilities for high throughput of wafers, meaning they can only planarize a limited number of wafers at a time due to distortions occurring in the platen. More particularly, in the past only the outer marginal portion of a wafer carrier could be utilized to produce wafers having the necessary planar tolerance acceptable in the industry. By utilizing the present inventive method, the entire wafer carrier surface may be utilized, resulting in the ability to load each wafer carrier with much more product, and even larger single wafers covering the entire wafer carrier may be produced with a premium level of planarization. For example, when an 18" diameter wafer carrier is utilized, the wafers to be polished may be 18" in diameter. Likewise, when a 12" diameter wafer carrier is utilized, a 12" in diameter wafer may be planarized In situation where wafers are loaded on a 12" carrier, in the past, only thirteen 2" wafers could be polished and were only located on the outer marginal peripheral of the wafer carrier. However, with the present inventive method, twenty 2" wafers may be polished with thirteen wafers lining the outer marginal peripheral of the wafer carrier while the remaining seven 2" wafers may be positioned in the central portion of the wafer carrier or in the inner peripheral of the wafer carrier, resulting in an approximate 50% increase in the amount of product which may be processed in a single operation.

Likewise, in the past, only 4" wafers could be produced to the necessary planarization tolerance standards commonly accepted in the industry for planarization on a 12" wafer carrier. With the present inventive method, larger wafers may now be produced, that is 12" wafer carriers may produce a 12" wafer product and an 18" wafer carriers may produce an 18" wafer product.

Furthermore, the present invention solves many prior art problems by polishing a high throughput of uniform planar wafers using a process of counterbalanced rotating heads and concentric conditioning rings which reduces the distortion of the platen occurring during the lapping process, and thus substantially improves the quality of the wafers.

The present invention consists of a process utilizing a lapping apparatus containing: a rotary lapping platen of metal, ceramic or other suitable composite material which is a flat table grooved with spiral, concentric, squared, diamond grooves, or a wide variety of groove shapes and designs may be used; a plurality of rotating pairs of pressurized heads; a plurality of polishing wafer carriers, each adapted to receive one or more wafers mounted there upon; a plurality of concentric conditioning rings; and a slurry dispenser. The present inventive process comprises the steps of: 1) removably affixing at least one wafer to a polishing wafer carrier; 2) providing an abrasive slurry at a desired flow rate; 3) selecting and setting a polishing down force pressure; 4) selecting and setting a polishing time; 5) selecting and setting a rotational speed of the rotary flat, grooved lapping platen; 6) continuously conditioning the lapping platen by rotating a plurality of concentric conditioning rings upon the lapping platen; 7) operating the lapping apparatus with a plurality of pairs of counterbalanced pressurized heads rotating simultaneously in both clockwise and counterclockwise directions; 8) selecting and setting a rotational speed of each rotating pressurized head. Generally, the lapping platen operates in a counterclockwise direction, although either direction is acceptable for the practice of the present inventive lapping method.

Pursuant to the present inventive method, in one preferred embodiment the rotating pressurized heads are counterbalanced by rotating a first pair of pressurized heads clockwise while rotating a second pair of pressurized heads counterclockwise with optimally adjusted rotations per minute (rpm) and an optimum downward pressure applied to the wafers, all while the lapping platen is rotating in either the clockwise or counterclockwise directions. The counterbalanced rotation of heads provides continuous correction of concave or convex development of the lapping platen across its diameter. In addition, the concentric conditioning rings with the optimized overhang over the lapping platen reduces the development of trenching in the lapping platen across its radius by concurrently applying optimized pressure during the lapping process. Therefore, the present inventive method for using the lapping apparatus allows continuous and controllable planarization based upon a high throughput of wafers by means of trench and distortion free flat platen maintenance. The method also reduces maintenance on the lapping platen by allowing for continuous conditioning of the platen.

The plurality of wafer carriers of the lapping apparatus utilized for the present inventive lapping process may be made from, but are not limited to, Silicon Carbide (SiC), Alumina, and Stainless Steel, while the concentric conditioning rings may be made from stainless steel or other tough, durable, corrosion resistant materials commonly utilized in the semiconductor industry, and the lapping platen may be made from materials that include, but are not limited to: Tin (Sn), Copper (Cu) or its Composite.

OBJECTS OF THE INVENTION

Thus, it is one primary object of the present inventive method to provide a method for polishing uniform and planar wafers made from semiconductors, sapphire, as well as a wide variety of other materials and configurations where the rotating polishing pressurized heads on a lapping apparatus are counterbalanced by rotating at least one half of polishing pressurized heads in pairs, where one head rotates in the clockwise direction while the other rotates in the counterclockwise direction. One or more pairs of pressurized heads may be provided to practice the inventive method.

It is yet another primary object of the present inventive method utilizing counter-balanced pairs of rotating pressure heads to provide a polishing method in which the polishing platen is continuously conditioned in-situ with concentric conditioning rings which have independent pressure control and optimal extent of overhang, thus providing a real time correction of trench development and other distortion occurring in the platen and avoiding the expense and inconvenience of additional platen maintenance procedures between the processing of wafer batches.

It is yet another primary object of the present inventive method to provide a polishing method which results in a highly uniform thickness throughout the entire area of the wafer via the use of counterbalanced pairs of rotating polishing pressurized heads operating in conjunction with concentric conditioning rings pressed upon the lapping platen.

It is yet another primary object of the present inventive method to provide a polishing method which reduces the amount of taper in a wafer via the use of counterbalanced pairs of rotating polishing pressurized heads operating in conjunction with concentric conditioning rings pressed upon the lapping platen.

It is a further primary object of the present inventive method to provide a polishing method that reduces the amount of convex or concave across the diameter of the lapping platen and/or trenching across the radius by utilizing counterbalanced pairs of rotating polishing pressurized heads operating in conjunction with concentric conditioning rings pressed upon the lapping platen.

It is still an additional object of the present inventive method to provide a polishing method which makes it possible to utilize the entire surface of a wafer carrier; resulting in a larger sized wafer product to be produced according to the required industry tolerances for planarization, and/or a greatly increased number of wafers may be positioned on a wafer carrier in instances where more than one smaller wafer is to be processed in a single operation.

These and other objects and advantages of the present inventive method can be readily derived from the following detailed description of the drawings taken in conjunction with the accompanying drawings present herein and should be considered as within the overall scope of the invention.

DETAILED DESCRIPTION OF THE DRAWINGS

Figure 1:
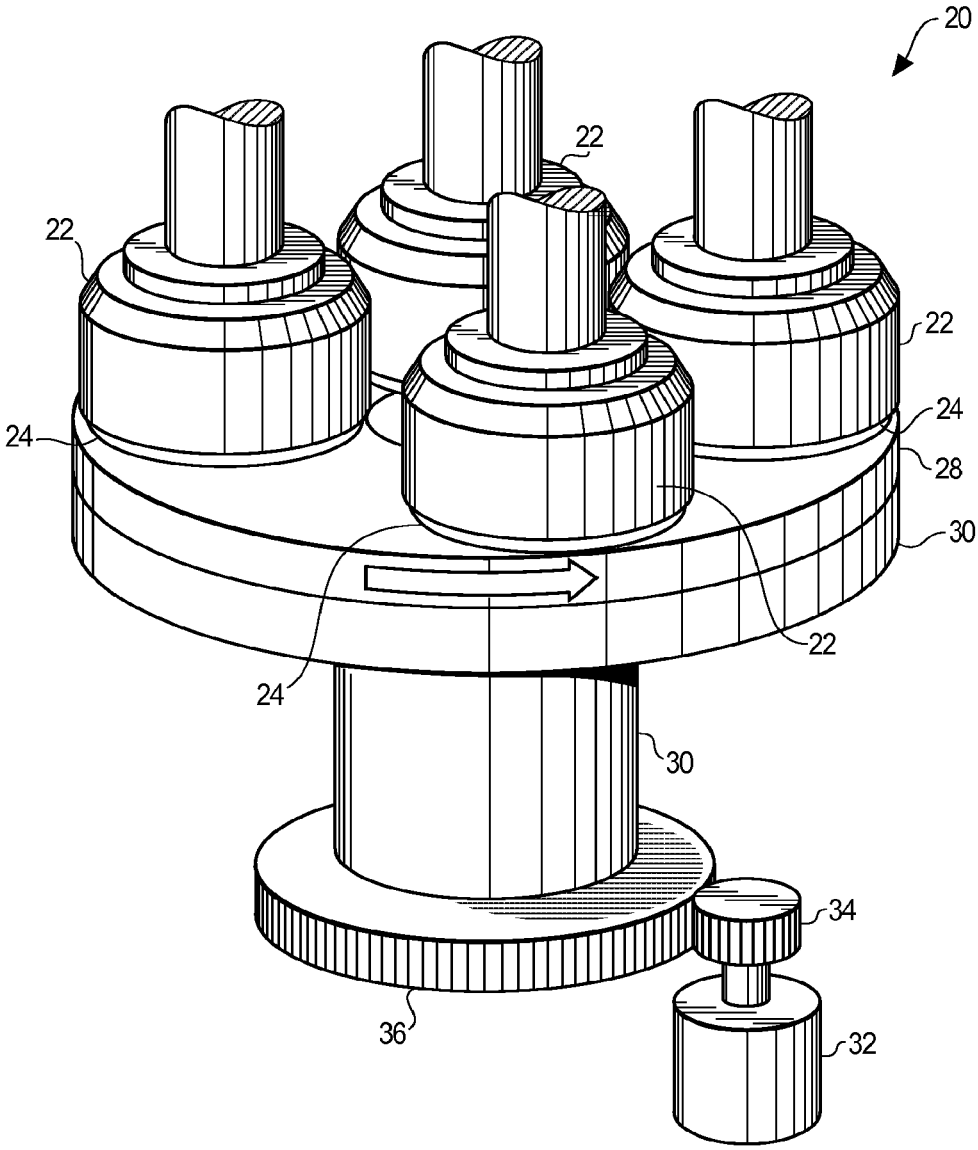
FIG. 1 is a front perspective view of a lapping apparatus according to a preferred embodiment of the present inventive process.

FIG. 1 shows a front perspective view of one preferred embodiment of a lapping apparatus 20 used to carry out the present inventive lapping process. In this preferred embodiment, the lapping apparatus 20 may comprise four rotating pressurized heads 22, rotatable in either the clockwise or counterclockwise directions. Removably secured to the bottom of each rotating pressurized head 22 is a set of wafer carriers 24, and removably attached upon the wafer carriers 24 are the wafers 26 shown in FIGS. 2 and 3. Along the base of the lapping apparatus 20 is the lapping platen 28 which is secured atop the platen spindle assembly 30 and a rotating motor 32 has been provided. Motor 32 is affixed to drive gear 34 which provides rotational motion to the driven gear 36 which turns the lapping platen spindle assembly 30.

Figure 2:
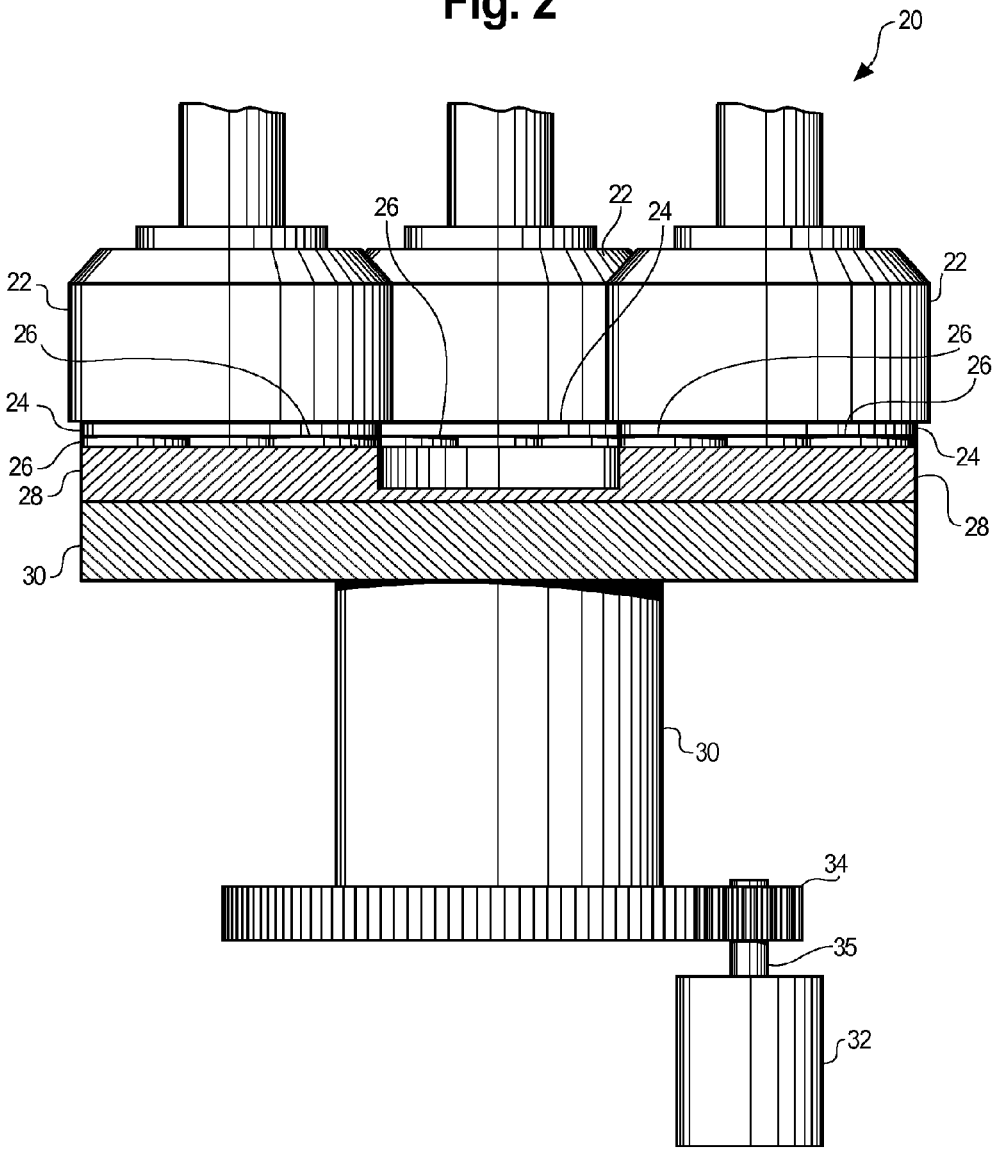
FIG. 2 is a side elevation view of a simplified diagram of a lapping apparatus according to a preferred embodiment of the present inventive process.

FIG. 2 shows a side elevation view of the lapping apparatus 20 that may be used for the present inventive lapping process where the wafers 26 are secured to wafer carriers 24 by a means common in the semiconductor industry, such as using wax applied at approximately 5 psi as a temporary adhesive, or by placing the wafers in a template affixed upon the front side surface of a wafer carrier. Here, the wafer carriers 24 are made from, but are not limited to: Silicon Carbide (SiC), Alumina, Stainless Steel, and any other material commonly used in the industry. The wafer carriers 24 are approximately 12.0" in diameter, and are removably secured upon the base of the rotating pressurized heads 22. Along the base of the lapping apparatus 20, the spirally grooved lapping platen 28 is secured atop platen spindle 30. This spirally grooved lapping platen 28 preferably is comprised of material able to grind and polish the wafer in combination with an abrasive slurry without creating deep surface damage to the lapping platen 28. The lapping platen 28 may be preferably 36.0" in diameter or larger and the materials the lapping platen 28 is made from may be, but is not limited to: Tin (Sn), Copper (Cu), or a composite thereof. After the wafers 26 have been removably secured to wafer carriers 24, they are pressed between the rotating pressurized heads 22 and the lapping platen 28. In this preferred embodiment of the present inventive method, the pressurized heads 22 are approximately 12.0" in diameter. To planarize the wafers, the lapping apparatus 20 is counterbalanced by rotating a first pair of pressurized heads 22 counterclockwise while rotating a second pair of pressurized heads 22 clockwise, with independently controlled rotations per minute (rpm) and at a downward pressure as selected by the user. While the rotating pressurized heads 22 operate, the lapping platen 28 rotates in either a clockwise or counterclockwise direction. As the pressurized heads 22 and lapping platen 28 rotate, a slurry is continuously provided and is dispensed upon the lapping platen 28. The abrasive slurry may be made from compositions commonly utilized in the semiconductor lapping and polishing industry, but preferably may consist of diamond abrasive slurry for sapphire wafers. Of course, while FIG. 2 shows two pairs of rotating counterbalanced pressurized heads, one, two, or more pairs of pressurized heads may be utilized as desired to practice the present inventive lapping method.

Figure 3:
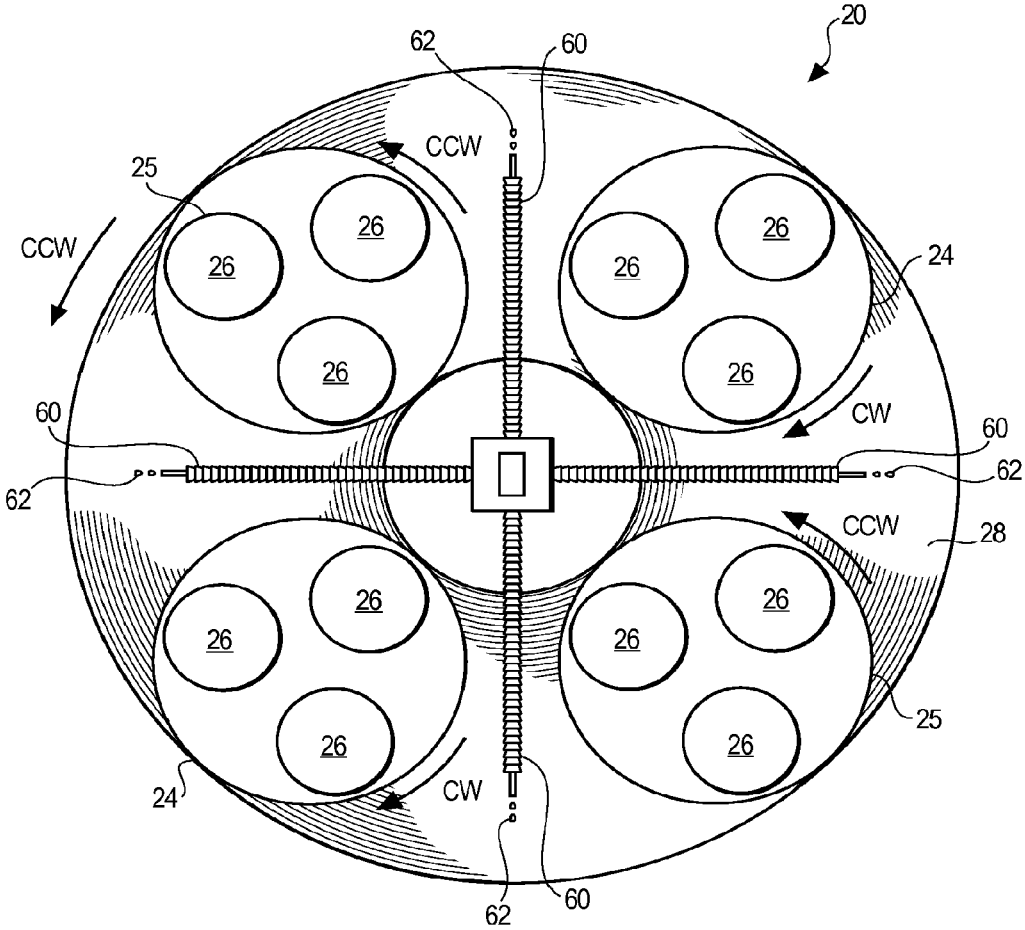
FIG. 3 is a top elevation view of the lapping platen and the four wafer carriers.

FIG. 3 shows a top elevation view of a lapping platen apparatus 20 and the four wafer carriers 24 in the present preferred embodiment of the present inventive method. It shows wafer carriers 24 each containing three 4" wafers 26. The wafer carrier 24 is approximately 12.0" in diameter. A grooved lapping platen 28 is secured upon a platen spindle 30 as shown in FIG. 1. FIG. 3 shows a pair of wafer carriers 24 opposing one another which rotate in the same direction, while another pair of wafer carriers 25 rotate in the opposite direction. This rotational counterbalancing allows for the continuous conditioning and the substantial reduction in concave or convex shape development of the lapping platen 28 across the diameter. Accordingly, this counterbalancing rotating method also allows for enhanced uniformity in the wafers 26 produced according to the present inventive method. FIG. 3 also shows slurry dispenser 60, which preferably continually dispenses an abrasive slurry 62 containing diamond or other abrasive materials which polishes the wafers 26. The slurry does not necessarily need to be abrasive, but in many instances an abrasive slurry is highly desired and would commonly be made from materials such as: diamond, silicon carbide, ceria, alumina, and any other abrasive material. This figure should not be construed to limit the number of wafers per wafer carrier to this diagram, as the same wafer carrier could carry more smaller wafers, or fewer larger wafers.

Likewise, the size of the wafer carrier 24 affects how many wafers 26 may be affixed to each carrier 24. In this preferred embodiment of the present inventive method, the wafer carriers 24 are approximately 12.0" in diameter and may each hold three 4.0" wafers 26 or thirteen 2.0" wafers 26 mounted along the outer marginal annular portion and seven 2.0" wafers 26 mounted along the inner portion of the wafer carrier 24.

The lapping platen 28 is provided with narrow spiral grooving 29. Lapping platens commonly used in the industry may be grooved according to a variety of patterns. They may be arranged in a spiral formation, in concentric circles combined with multiple radial lines, square or rectangular grid formations, or diamond-shaped grid formations, or as desired by the user. The entire lapping plate 28 rotates independently of the wafer carriers 24 and pressurized heads 22.

Figure 4:
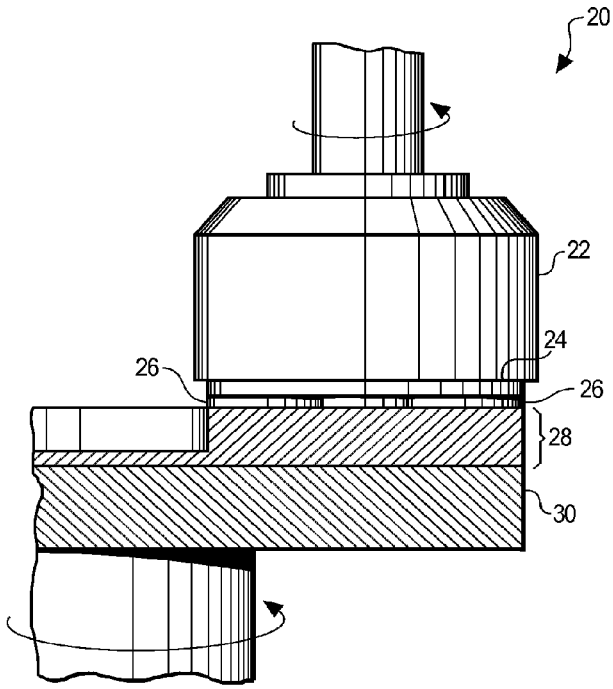
FIG. 4 is a side elevation partial view of a pressurized head pressing a wafer carrier upon the lapping platen.

FIG. 4 shows a side elevation partial view of a rotating pressurized head 22 pressing a wafer carrier 24 upon the grinding surface of the lapping platen 28. The pressurized head 22 rotates in one direction, either clockwise or counterclockwise, independently of the rotation of the lapping platen 28. Wafer 26 are removably secured to wafer carrier 24 and lapping platen 28 is mounted atop platen spindle 30.

Figure 5:
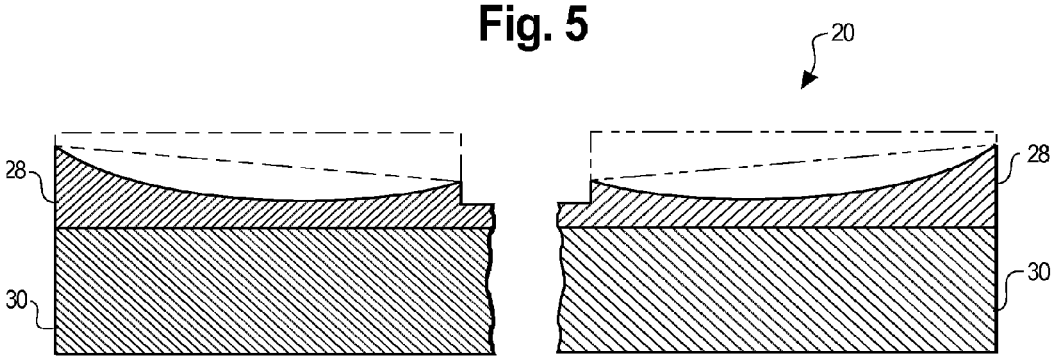
FIG. 5 is a side elevation partial cross sectional view of the resulting concave lapping platen when the polishing process is run by the counterclockwise rotation of both the wafer carrier and the lapping platen.

FIG. 5 shows a side elevation partial cross sectional view of a prior art example of the lapping platen 28 where the polishing process operates with counterclockwise rotation of the wafer carrier 24, pressurized heads 26, lapping platen 28, and a mounting spindle 30 as shown in FIG. 4. In FIG. 5, a concave distortion of the lapping platen 28 across the diameter and trenching across its radius typically occurs during lapping procedures and is highly undesirable. Distortion in the lapping platen 28 produces lapped and polished products having uneven thickness not acceptable to the consumer of these products. The entire production process of wafers must be shut down while the lapping platen 28 deformities are corrected and the lapping platen 28 is refaced or resurfaced. Concave distortion and trenching of the lapping platen 28 is vastly reduced by using the present inventive method rather.

Figure 6:
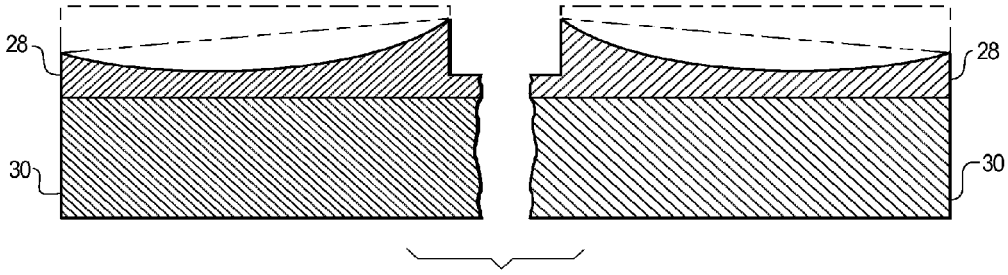
FIG. 6 is a side elevation partial cross sectional view of the resulting convex lapping platen when the polishing process is run with the wafer carriers rotating clockwise and the lapping platen rotating counterclockwise.

Likewise, FIG. 6 shows a side elevation partial cross sectional view of a prior art example of the lapping platen 28 when the polishing process operates with clockwise rotation of the wafer carrier and pressurized heads, and the counterclockwise rotation of the lapping platen 28 results in the convex configuration of the lapping platen 28 shown. This convex distortion of the lapping platen 28 occurs across the diameter and trenching forms across the radius of lapping platen 28. Convex distortion and trenching of the lapping platen 28 is vastly reduced by using the present inventive method. Also show in FIG. 6 is platen spindle 30 which supports lapping platen 28.

Figure 7:
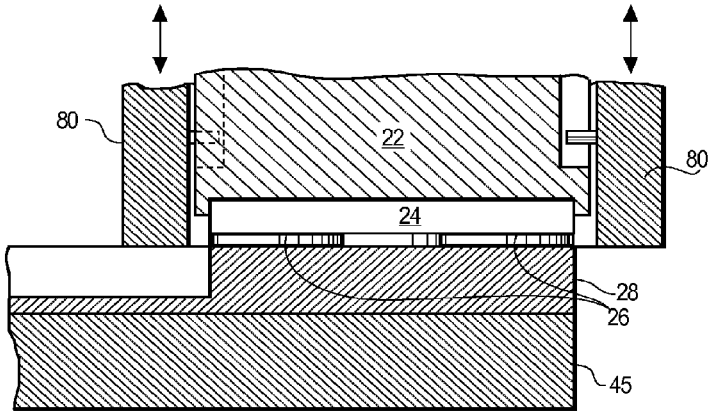
FIG. 7 is an elevation cross sectional partial view of the concentric conditioning ring installed around a single pressurized head, shown together with wafers, the wafer carrier, and lapping platen.

FIG. 7 shows an elevation cross sectional partial view of concentric conditioning ring 80 surrounding the pressurized rotary head 22 where wafers 26 have been removably affixed to wafer carrier 24, pressed upon the lapping platen 28. It shows pressurized rotary head 22 surrounded by concentric conditioning ring 80. Concentric conditioning ring 80 is provided so as to assist in eliminating the trenches shown in FIGS. 5 and 6. While the concentric conditioning rings 80, when used by themselves, may not completely eliminate trenching and platen distortions, when they are used in conjunction with pairs of rotating counterbalanced pressurized heads, trenching and platen distortions are then eliminated. Concentric conditioning ring 80 may be made from any tough, durable, corrosion resistant materials such as stainless steel or other metal alloys and the like.

Figure 8:
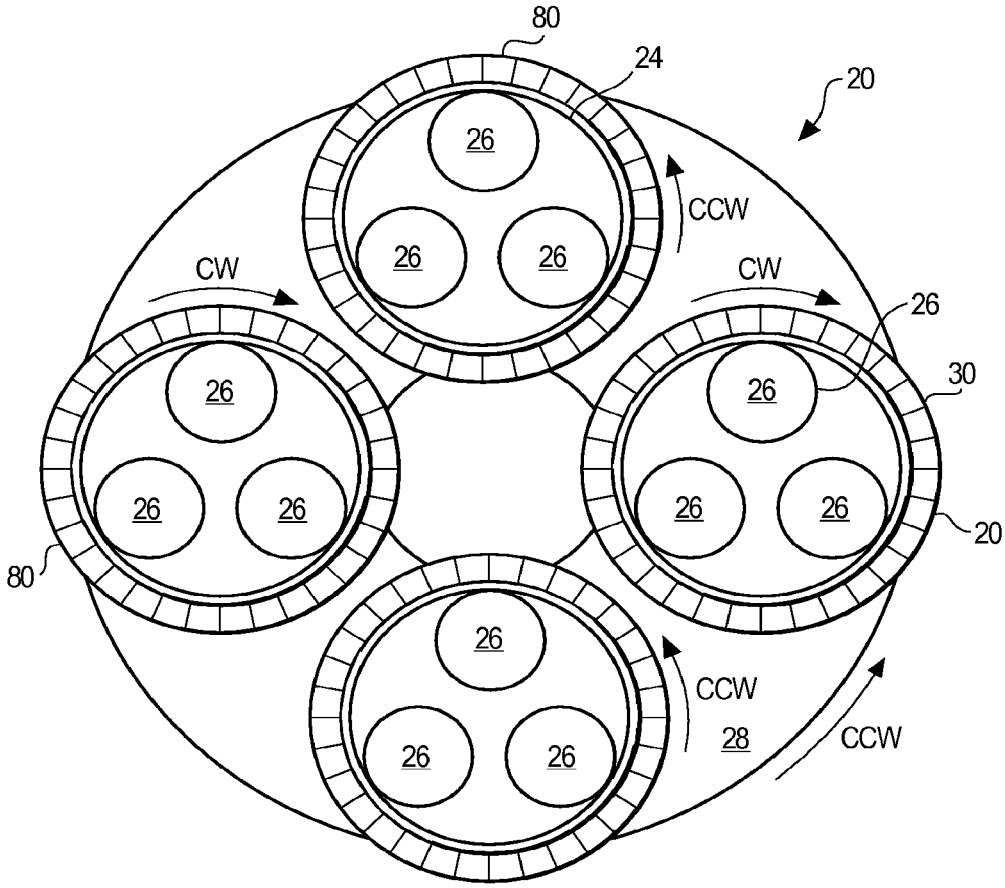
FIG. 8 is a top elevation view of the concentric conditioning ring installed around the pressurized head.
Figure 9:
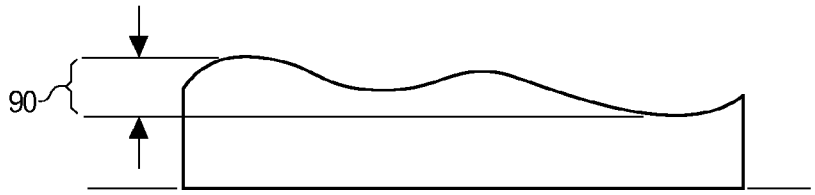
FIG. 9 is a diagram of the Total Thickness Variation ("TTV") for a wafer.

FIG. 8 shows a top elevation view of the concentric conditioning ring 80 installed around the pressurized heads 22. FIGS. 7 and 8 show one preferred embodiment of the present inventive method where concentric conditioning rings 80 and the pressurized heads 22 are mechanically coupled together to rotate in the same direction with independent pressure control of each pressurized head 22 further being provided. However, the lapping apparatus 20 may also consist of concentric conditioning rings 80 and pressurized heads 22 that independently rotate and have independent pressure controls and settings. The concentric conditioning rings 80 should be used with an optimal pressure setting and an appropriate overhang to reduce the trench development across the radius upon the lapping platen 28 concurrently during the present inventive lapping process FIG. 9 shows a diagram demonstrating how total thickness variation ("TTV") 90 of a wafer 26 is calculated. TTV is the difference between the highest and lowest elevation of the front surface of the wafer specimen with respect to the back reference surface 100. This is an accepted method of determining overall wafer quality commonly utilized in the industry.

Figure 10:
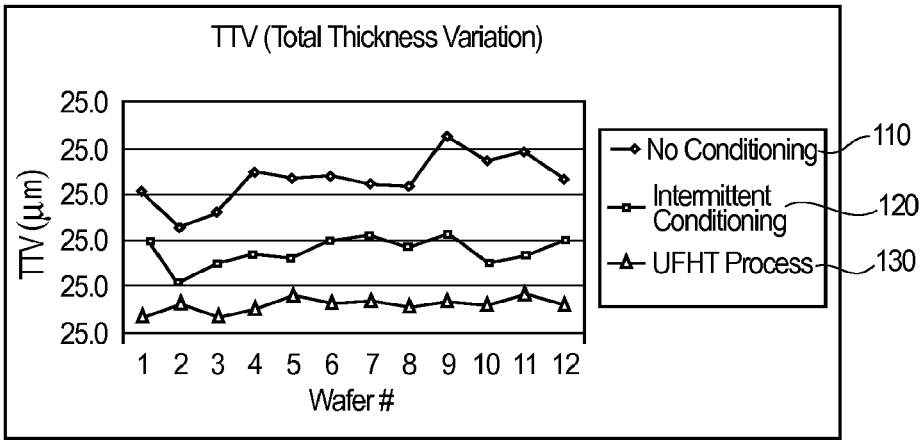
FIG. 10 is a graph comparing the Total Thickness Variation ("TTV") values for wafers polished using different processes.

FIG. 10 shows a graph showing the difference in TTV values 90 for wafers 26 processed using different techniques. The graph is drawn from the following chart:

TTV (Total Thickness Variation)

| Wafer # | No Conditioning (μm) | Intermittent Conditioning (μm) | Present inventive, UFHT Process (μm) |
|---|---|---|---|
| 1 | 15.3 | 11.0 | 2.1 |
| 2 | 11.5 | 5.4 | 3.4 |
| 3 | 13.2 | 7.8 | 2.2 |
| 4 | 17.5 | 8.5 | 2.8 |
| 5 | 16.7 | 8.3 | 4.2 |
| 6 | 17.0 | 9.9 | 3.3 |
| 7 | 16.1 | 10.2 | 3.6 |
| 8 | 15.8 | 9.2 | 2.8 |
| 9 | 21.2 | 10.4 | 3.5 |
| 10 | 18.3 | 7.2 | 3.1 |
| 11 | 19.4 | 8.1 | 4.4 |
| 12 | 16.4 | 9.8 | 3.2 |
| Ave | 16.5 | 8.8 | 3.2 |
| Stdev | 2.6 | 1.6 | 0.7 |

As is evident from this graph, the TTV value 90 for wafers processed using no conditioning 110 are substantially higher than the values for those processed using intermittent conditioning 120 or the present inventive Ultra-Flat, High-Throughput ("UFHT") process 130. The wafers 26 which were processed using the present inventive UFHT process 130 had the lowest TTV value 90 of any method shown.

Figure 11:
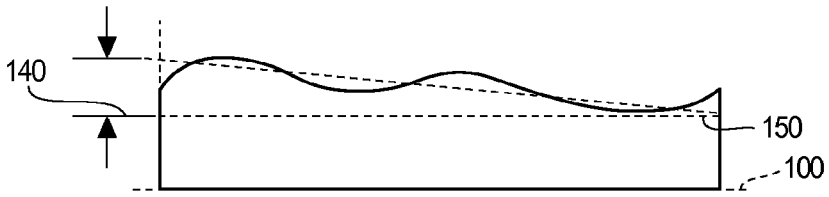
FIG. 11 is a diagram of the Taper of a wafer.

FIG. 11 shows a diagram of the taper value for a given wafer. Taper 140 is the lack of parallelism between the back reference surface 100 of the wafer test subject and the best fit plane 150. The numeric value reported is the amount of rise in the best fit plate 150 over the entire surface of the part.

Figure 12:
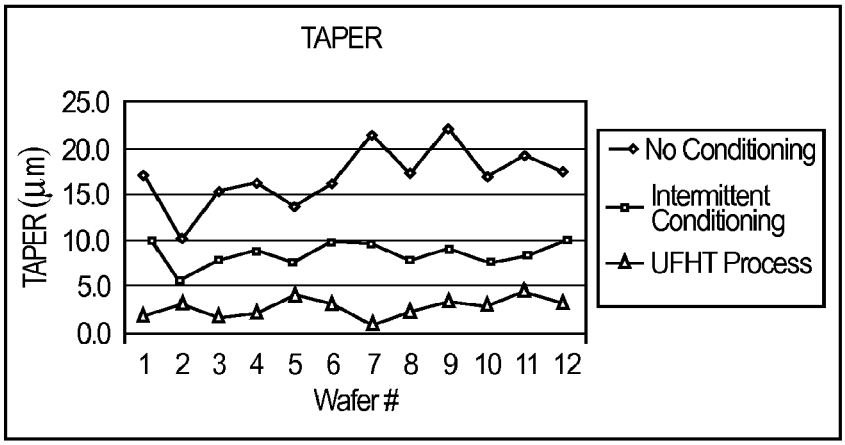
FIG. 12 is a graph which compares the Taper values for wafers polished using different processes.

FIG. 12 shows a chart comparing the different taper values 140 for wafers 26 process using different methods. The graph is based on the data in the following table:

TAPER

| Wafer # | No Conditioning (μm) | Intermittent Conditioning (μm) | Present inventive, UFHT Process (μm) |
|---|---|---|---|
| 1 | 17.2 | 11.2 | 2.3 |
| 2 | 10.5 | 5.8 | 3.5 |

-continued

| TAPER | | | |
|---|---|---|---|
| Wafer # | No Conditioning (μm) | Intermittent Conditioning (μm) | Present inventive, UFHT Process (μm) |
| 3 | 15.6 | 8.2 | 2.1 |
| 4 | 16.4 | 9.1 | 2.6 |
| 5 | 13.9 | 7.9 | 4.5 |
| 6 | 16.3 | 10.3 | 3.4 |
| 7 | 21.4 | 10.2 | 1.2 |
| 8 | 17.3 | 8.5 | 2.5 |
| 9 | 22.2 | 9.2 | 3.6 |
| 10 | 16.9 | 8.3 | 3 |
| 11 | 19.1 | 8.5 | 4.8 |
| 12 | 17.5 | 10.2 | 3.7 |
| Ave | 17.0 | 9.0 | 3.1 |
| Stdev | 3.1 | 1.4 | 1.0 |

As is evident from this graph, the taper 140 value for wafers processed using no conditioning 110 are substantially higher than the values for those processed using intermittent conditioning 120 or the present inventive UFHT process 130. The wafers 26 which were processed using the present inventive UFHT process 130 had the lowest taper 140 value of any method shown.

Figure 13:
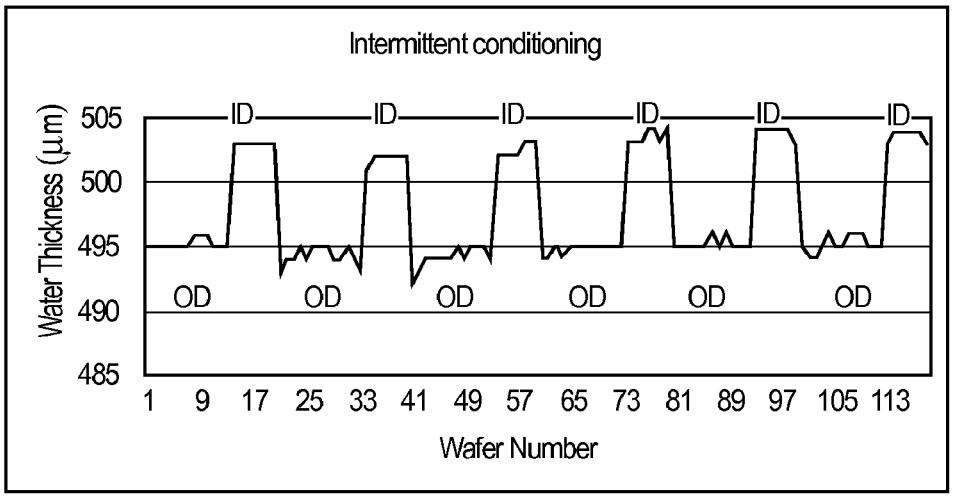
FIG. 13 is a graph which shows the wafer thickness for wafers polished using an intermittent conditioning method.

FIG. 13 shows a graph which illustrates the difference between wafers 26 which have been positioned on the outer marginal portion or near the outer diameter ("OD") of a wafer carrier 24 and wafers 26 which have been positioned in the central portion or near the inner diameter ("ID") of a wafer carrier 24 that is subject to the intermittent conditioning 120 method of processing commonly utilized in the prior art. This shows that while the wafers positioned nearest the inner diameter ("ID") have a relatively consistent thickness and the wafers on the outer diameter ("OD") have a relatively consistent thickness, the inner diameter and outer diameter wafers vary substantially overall in thickness from each other. This substantial variation in thickness between the ID and OD areas significantly hinders the implementation of a high throughput process design due to its inherent poor process control and such product thickness variation are not acceptable at all to the consumer of such products. Because of these unacceptable thickness variations in wafers processed near the outer marginal portion of the wafer carrier and those processed nearest the interior of a wafer carrier, wafer material could not be processed in the inner portion of the wafer carrier. This criteria substantially limited both the size and number of wafers to be processed on a given carrier.

Figure 14:
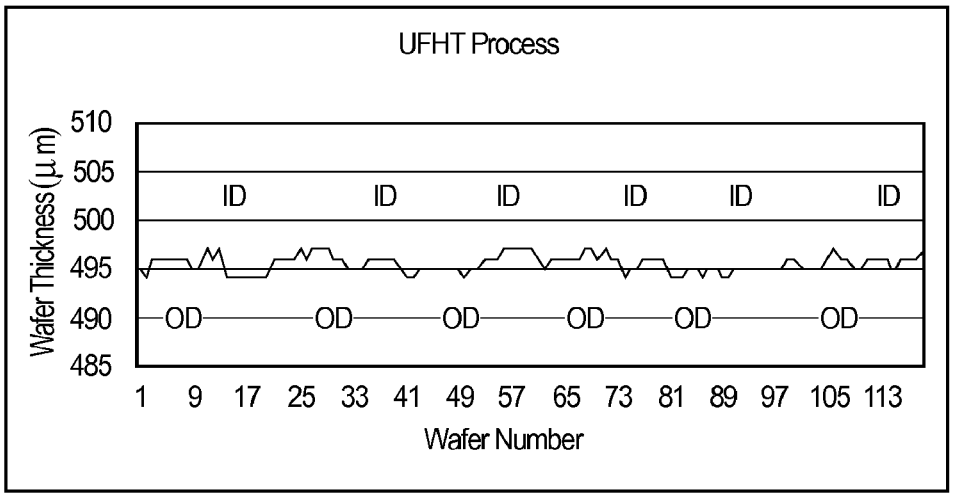
FIG. 14 is a graph showing the wafer thickness for wafers polished using the present inventive, ultra flat high throughput ("UFHT") process.

FIG. 14 shows a graph which illustrates the difference between wafers 26 positioned near the inner diameter ("ID") or inner portion and those wafers that have been positioned near the outer diameter ("OD") or outer marginal portion of a wafer carrier 24 subject to the present inventive UFHT process 130 consisting of the use of counterbalanced rotating pressurized heads 22 and concurrently rotating concentric conditioning rings 80 used to condition the lapping platen 28 during processing of wafers 26. The graph clearly demonstrates negligible variation in the thickness of the wafers 26, regardless of their position on the wafer carrier 24. Such low levels of thickness variation product produced is highly desirable in the relevant industry.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. An apparatus for polishing wafers and other substantially thin, rigid materials, comprising:

a rotatable flat, lapping platen;

a plurality of wafer carriers, each adapted to receive at least one wafer;

a plurality of rotatable pressurized heads configured to rotate in counterbalanced pairs in both clockwise and counterclockwise directions and configured to apply pressure against the plurality of wafer carriers and the lapping platen; and a plurality of concentric conditioning rings configured around a respective one of the plurality of rotatable pressurized heads.

2. The apparatus of claim 1, wherein the plurality of rotatable pressurized heads are each independently programmable with one of: a force setting and a rotational speed.

3. The apparatus of claim 2, wherein the force setting is selectable from a range of about 50 g/cm$^2$ to about 650 g/cm$^2$.

4. The apparatus of claim 2, wherein the rotational speed is selectable from about 20 to about 60 revolutions per minute.

5. The apparatus of claim 1, wherein each of the plurality of wafer carriers is adapted to receive a plurality of wafers.

6. The apparatus of claim 1, wherein the lapping platen is configured in a geometric pattern.

7. The apparatus of claim 6, wherein the geometric pattern is spiral.

8. The apparatus of claim 1, wherein the plurality of wafer carriers are each adapted to receive a plurality of mounted wafers.

9. The apparatus of claim 1, further comprising a mechanism for providing slurry at a desired flow rate.

10. The apparatus of claim 9, wherein the desired flow rate is selectable from a rate substantially between 1 ml/min to 200 ml/min.

* * * * *